US005253378A

United States Patent [19]

Jung, Jr.

[11] Patent Number: 5,253,378

[45] Date of Patent: Oct. 19, 1993

[54] SPOT CLEANING SYSTEM AND METHOD

[75] Inventor: Herbert C. Jung, Jr., Spartanburg, S.C.

[73] Assignee: Cherokee Products, Inc., Gaffney, S.C.

[21] Appl. No.: 876,489

[22] Filed: Apr. 30, 1992

Related U.S. Application Data

[63] Continuation of Ser. No. 775,637, Sep. 9, 1991, Pat. No. 5,203,044.

[51] Int. Cl.[5] ..... D06F 43/00; D06B 5/24

[52] U.S. Cl. ..... 8/149.1; 8/149.3; 8/158; 68/5 R; 68/20; 68/205 R; 68/240

[58] Field of Search ..... 8/149.1, 149.3, 158; 68/5 R, 5 A, 6, 20, 205 R, 222, 240

[56] References Cited

U.S. PATENT DOCUMENTS

| | | | |
|---|---|---|---|
| 2,254,691 | 9/1941 | MacLelland, Jr. | 68/240 X |
| 2,295,718 | 9/1942 | Dahlberg | 68/240 X |
| 2,434,404 | 1/1948 | Goodwin | 68/240 |
| 2,602,315 | 7/1952 | Shoop et al. | 68/6 |
| 2,657,566 | 11/1953 | Richterkessing | 68/240 |
| 2,707,874 | 5/1955 | Glover, Jr. | 68/5 |
| 2,922,694 | 1/1960 | Avera . | |
| 3,030,792 | 4/1962 | Bader | 68/240 |
| 3,320,780 | 5/1967 | Frahm | 68/240 |
| 3,427,831 | 2/1969 | Frauendorf | 68/240 |
| 3,619,830 | 11/1971 | Harris et al. . | |
| 4,120,180 | 10/1978 | Jedora . | |
| 4,434,012 | 2/1984 | Eckert et al. | 134/25.4 |
| 4,926,514 | 5/1990 | Levenberger . | |

FOREIGN PATENT DOCUMENTS 1005892 1/1986 Japan .

*Primary Examiner*—Philip R. Coe
*Attorney, Agent, or Firm*—Dority & Manning

[57] ABSTRACT

A substantially self-contained system and corresponding method provides practical spot cleaning of soiled garments without requiring the use of chlorinated solvents. A soiled garment may optionally be pretreated with either of a water based or petroleum based non-chlorinated cleaner. Thereafter, a relatively high level of vacuum force is applied to the soiled garment to be cleaned, and comprises the flushing agent for both the soil and the pretreatment cleaner. Drying effects obtained with the vacuum force may be augmented by the addition of compressed air directed onto the garment. A self-contained workstation practicing such methodology may optionally include an electric water boiler for generating steam to be applied as a supplement to vacuum and also include an industrial grade vacuum pick-up with a waste collector for generating the relatively high vacuum force, preferably at least about 80 inches of mercury of static pressure.

23 Claims, 2 Drawing Sheets

SPOT CLEANING SYSTEM AND METHOD

Benefit under 35 U.S.C. §120 is claimed based on the commonly assigned U.S. patent application Ser. No. 07/755,637, filed by the present Applicant on Sep. 9, 1991, this application being a continuation of the prior '637 application, which is now U.S. Pat. No. 5,203,044, issued on Apr. 20, 1993.

BACKGROUND OF THE INVENTION

The invention concerns in general a spot cleaning system and methodology and, in particular, is concerned with improved spot cleaning operations which provide practical method and apparatus which obviates the use of potentially harmful chlorinated solvents.

Conventional, basic technology with respect to commercial cleaning arrangements has existed for many years. However, more recently, practice of conventional techniques has been challenged by factors not previously fully appreciated. For example, commercial cleaning operations have long used devices generally referred to as a "spotting board" for spot cleaning, i.e., concentrated cleaning of a given spot or stain on a soiled garment. Generally speaking, such apparatuses have included a user workbench or workstation at which the soiled garment to be cleaned is treated. Frequently, use of such spot cleaning technique involves use of a chlorinated solvent. Generally speaking, chlorinated solvents have for many years been the industry standard for spot cleaning.

More recently, there has been considerable pressure in numerous industries to respond to environmental concerns. As worldwide studies progress, it has become recognized that certain heretofore accepted practices (including, in some instances, industry standard practices) have specific adverse environmental affects and/or contribute adversely to the environment. Chlorinated solvents are a specific example of such a situation.

Relatively recently, an international document referred to as the "Montreal Protocol" dealt with the widespread and significant problem of ozone layer depletion in the earth's atmosphere. Specifically, it is thought that chlorinated solvents are one contributing factor to ozone layer depletion or damage.

Typically speaking, chlorinated solvents are extremely fast drying, which means that their use is highly advantageous in the cleaning industry since the garment being cleaned, in effect, dries rapidly. What, in fact, is taking place is that the highly volatile chlorination in the solvents is evaporating into the atmosphere. Because generally the evaporating substance or chlorine gas is unreactive with other elements, the escaping material makes it way into areas of the earth's atmosphere so as to result in damage to the ozone layer, as referenced above.

The United States levied a federal excise tax of Eighty Dollars ($80) per 55 gallon drum of chlorinated solvents, effective as of Jan. 1, 1991. The excise tax is designed to begin shifting the cleaning industry towards elimination of chlorinated solvents. At present, the excise tax is scheduled to double (i.e.. increase to One Hundred Sixty Dollars ($160) per 55 gallon drum of chlorinated solvent) as of 1995. Other legislation is being considered due to the ever increasing recognition of the negative consequences of using chlorinated solvents. It is presently thought that chlorinated solvents may ultimately be entirely eliminated from the cleaning industry, either by regulation or due to relative expense.

Because prior industry practices relied heavily on chlorinated solvents, drying considerations have heretofore been avoided as a major problem. However, as is now more clearly understood, the drying problem associated with spot cleaning or other cleaning practices was simply being handled with a short-term solution which had highly negative long-term ramifications. Hence, the drying problem persists and a new urgency exists within the cleaning industry as to how best to practice comparable cleaning techniques (or if such is possible) without the use of (or perhaps even without the availability of) chlorinated solvents.

Prior devices, particularly pertaining to so-called "spotting boards" have made use of an upright element or arm on which a garment to be cleaned is received, and through which a degree of vacuum force is applied to the garment. Frequently, with the garment received in such a position (i.e., supported on a vacuum exhaust element), a workstation operator would work with the stain to be removed. In some instances, the above-referenced chlorinated solvents would be utilized. In other instances, it was known to make use of wet or dry steam either mixed with a solvent or without additional materials mixed therewith. As discussed, the generally pervasive use of chlorinated solvent minimized any problems with drying. However, in an arrangement such as the foregoing in which chlorinated solvents were not utilized, the existing apparatus and prevailing methodology was generally inadequate to routinely provide practical levels of drying for a wet garment being cleaned.

Examples of various prior art spotting boards are shown in the following United States patents. For example, Shoop et al. (U.S. Pat. No. 2,602,315) illustrates a combination device including a spotting board 1 and connections for a steam inlet (element 5*c*) and a vacuum line (element 6). The operator controls the amount of moisture in the steam as desired which is being issued from a spotting gun 20. The vacuum is drawn through a screen 1*b* and a vacuum channel 2 towards a condenser element 5.

In another prior art example of a garment spotting machine, Glover, Jr. (U.S. Pat. No. 2,707,874), illustrates use of a steam input (reference 58), which is subjected to a separator, so that "dry" and "wet" steam is made available. Two separate spray guns are then used, with a spotting gun 72 used with the steam and a water spray gun 94 used to discharge cold water onto a spotted area.

Richterkessing (U.S. Pat. No. 2,657,566) discloses another example of a prior art spotting board, which externally receives both compressed air and steam. Yet another prior art device which constitutes a spotting board which receives external inputs is referred to as a "Cissel" board manufactured by the Cissel Board Company of St. Louis, Mo. Such an arrangement requires an external vacuum to be hooked thereto, and steam to be brought in from an external line, typically from a full-sized steam boiler located at the commercial plant at which the board is being used. With such an arrangement, the external vacuum achieved may typically be no more than approximately 20 to 25 inches of mercury of static vacuum pressure. Such relatively low level of vacuum force would ordinarily be a sufficient amount of vacuum for drying purposes only whenever chlorinated solvents are utilized, as discussed above. Generally, such vacuum force would be inadequate if a garment being cleaned were wet from a water-based source.

Examples of other prior art devices making use of various features, such as external vacuum or steam inputs, are shown in the following U.S. patents.

| U.S. PAT. NO. | INVENTOR(S) | ISSUE DATE |
|---|---|---|
| 4,434,012 | ECKERT ET AL. | FEBRUARY 28, 1984 |
| 3,427,831 | FRAUENDORK | FEBRUARY 18, 1969 |
| 3,320,780 | FRAHM | MAY 23, 1967 |
| 3,030,792 | BADER | APRIL 24, 1962 |
| 2,434,404 | GOODWIN | JANUARY 13, 1948 |
| 2,295,718 | DAHLBERG | SEPTEMBER 15, 1942 |
| 2,254,691 | MACLELLAND, JR. | SEPTEMBER 2, 1941 |

Another aspect of changing circumstances in the cleaning industry is that locally available full-sized steam boilers are diminishing in number, which can tend to further increase the desire to make use of chlorinated solvents and/or other approaches which minimize drying problems. Likewise, centralized vacuum mechanisms tend to be of a relatively low vacuum level as referenced above, which is further reason for making use of virtually self-drying solvents such as chlorinated solvents. Typically larger bore hose connections or the like, such as connecting a vacuum line to the above-referenced "Cissel" board, is another reason for resultingly relatively low vacuum forces at the spotting board.

SUMMARY OF THE INVENTION

The present invention recognizes and addresses various of the foregoing problems, and others, concerning spot cleaning operations. Thus, broadly speaking, a principal object of this invention is improved spot cleaning operations, both apparatus and methodology. More particularly, a main concern is improved spot cleaning operations whereby the use of chlorinated solvents can be eliminated.

It is another particular object of the present invention to provide apparatus and methodology which provides an improved acceptable cleaning arrangement, including adequate drying thereof without the use of chlorinated solvents. More specifically, it is desired to provide a successful cleaning operation utilizing a relatively high level of vacuum force.

It is another general object of the present invention to provide such an improved cleaning arrangement (both method and apparatus) which may advantageously use water-based solvents in place of chlorinated solvents. Some embodiments may also or instead use a petroleum based non-chlorinated pretreatment cleaner. As a further more particular object thereof, it is desired to provide the foregoing advantageous arrangement in a substantially self-contained system so as to obviate the need for a full-sized boiler or other large scale equipment investments.

In view of the foregoing, it is a present object of the invention to provide an improved cleaning apparatus and method which is environmentally safe (particularly as compared with the prior industry standard use of chlorinated solvents) and which nonetheless provides a commercially acceptable level of cleaning. More particularly, it is desired to provide good cleaning results in a variety of fabrics, and effective on a number of tough stains, such as rust, food, oil, grease, ink, etc.

It is yet another more particular object to provide improved method and apparatus which results in obtaining the foregoing advantages without use of large amounts of water, which further facilitates provision of a substantially self-contained arrangement, as well as one which is environmentally sensitive.

It is also a present object to provide the foregoing advantages in a user workstation which incorporates various adjustable features to facilitate use thereof with the personal needs of each respective workstation operator, thereby maximizing efficiency and safety.

Additional objects and advantages of the invention are set forth, or will be apparent to those of ordinary skill in the art, from the detailed description which follows. Also, it should be further appreciated that modifications and variations to the specifically illustrated and discussed features and steps hereof may be practiced in various embodiments and uses of this invention without departing from the spirit and scope thereof, by virtue of present reference thereto. Such variations may include, but are not limited to, substitution of equivalent means, features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features or steps, or their equivalents (including combinations of features or steps or configurations thereof not expressly shown or stated). One exemplary such embodiment of the present invention relates to a substantially self-contained spot cleaning system, comprising a self-supporting workstation, electric water boiler means, a controllable steam spray gun, and vacuum means. Such self-supporting workstation is adapted for supporting other system components thereon, and includes a generally upright vacuum arm with a vacuum area at which vacuum force applied to the vacuum arm is focused. The boiler means are also supported on the workstation and are provided for generating steam at a steam output thereof. The controllable steam spray gun is operatively interconnected with the boiler means steam output through a steam hose. The vacuum means, also supported on the workstation, is provided for supplying a relatively high vacuum force to the vacuum arm. When applied, such vacuum force is in turn applied to a soiled garment to be cleaned and which is received on the vacuum arm at the vacuum area thereof. Steam is also applied to the garment with the controllable steam spray gun.

Another present exemplary embodiment comprises a method for substantially self-contained spot cleaning of soiled garments, substantially corresponding with the above-referenced spot cleaning system.

Yet another present methodology in accordance with the subject invention relates to a method of commercially spot cleaning soiled garments without the use of chlorinated solvent. Such method preferably comprises pretreating spots on the soiled garment to be cleaned by the application of water-based nonchlorinated cleaners thereto; applying a relatively high vacuum force to the pretreated spots; directing a flushing agent onto the pretreated spot of the garment being cleaned while continuing to apply the vacuum force thereto, so as to remove both soil and pretreatment cleaner therefrom; and subsequently drying the garment being cleaned.

In the foregoing method, the flushing agent preferably comprises steam, and the relatively high vacuum force is preferably at least about 80 inches of mercury of static pressure.

In some embodiments of the foregoing method, drying may be further enhanced by directing a stream of compressed air onto the garment.

In some other embodiments of this invention, both soil and pretreatment cleaner may be flushed from a pretreated soiled garment by application of a vacuum force thereto.

One present methodology for commercially spot cleaning soiled garments without the use of chlorinated solvents includes pretreating spots on the soiled garment to be cleaned by the application of nonchlorinated cleaners thereto, and applying a relatively high vacuum force to the pretreated spots so as to flush both soil and pretreatment cleaner therefrom and for drying the garment being cleaned. More preferably, a relatively high vacuum force of at least about 80 inches of mercury of static pressure is utilized in the foregoing method. Also, the nonchlorinated cleaner may be petroleum based.

Still further in such exemplary methodology, steps may be included for providing a substantially self-contained workstation having an upper work surface on which a user may work a soiled garment to be cleaned for pretreating same, a self-contained vacuum means for generating the relatively high vacuum force, a stand-up vacuum arm connected to such vacuum means and adapted for receiving a soiled garment thereon, and vacuum waste collector means carried on the workstation and associated with the vacuum means for collecting waste materials vacuumed through the vacuum arm under such vacuum force.

Still further, another embodiment of the present invention may comprise a system for commercially spot cleaning soiled garments without the use of chlorinated solvents, such system preferably including a user workstation; means for pretreating spots on the soiled garment to be cleaned by the application of nonchlorinated cleaners thereto; and vacuum means for selectively applying a relatively high vacuum force to the pretreated spots, so as to flush both soil and pretreatment cleaner therefrom as such garment is drying with such vacuum force. Again, the vacuum force involved preferably at least about 80 inches of mercury. Also, the nonchlorinated cleaner may in some embodiments preferably comprise petroleum based nonchlorinated cleaners.

Such a system may also further include, as above, a substantially self-contained workstation, a self-contained vacuum means, a stand-up vacuum arm, and vacuum waste collector means carried on such workstation.

The subject invention also relates to a system for commercially spot cleaning soiled garments, substantially in correspondence with the foregoing method.

Still another present method for commercially cleaning spots from garments using either a water or petroleum based nonchlorinated solvent involves initially providing a substantially self-contained user workstation operating on electrical power supplied thereto. Such workstation preferably has an upper work surface; a stand-up vacuum arm; an electrically powered self-contained water boiler steam generation system having a supply of water and an associated controllable steam spraying gun and steam hose; means for resting the steam spray gun when not in use; an electrically powered self-contained vacuum means for selectively supplying at least about 80 inches of mercury of static pressure vacuum force to the vacuum arm; a vacuum exhaust waster collector for collecting debris and dirty liquids vacuumed up with the vacuum force; and an electrically powered self-contained air compressor with an associated air spray gun and air hose.

With the foregoing method, the user workstation is provided electrical power; spots on garment to be cleaned are pretreated by applying either a water or petroleum based nonchlorinated cleaner thereto; the steam generation system is operated so as to generate steam available to a workstation user through operation of the controllable steam spray gun; the pretreated garment to be cleaned is placed onto the vacuum arm; the vacuum force of at least 80 inches of mercury of static pressure is applied to the garment to be cleaned by activating the vacuum means; with such vacuum force applied, the steam spray gun is operated for working the pretreated garment spot with steam, so as to clean the garment of its spot and flush the cleaner therefrom to be received under the vacuum force in the vacuum exhaust waste collector; and the garment is dried by operating the air spray gun so as to direct compressed air onto the garment while continuing to apply the vacuum force thereto. Thus the garment is cleaned and dried with either a water or petroleum based solvent in a substantially self-contained system and without use of chlorinated substances. The present invention encompasses an apparatus corresponding with such methodology.

Those of ordinary skill in the art will better appreciate the features and aspects of such embodiments and methods (and others) upon review of the remainder of the specification.

BRIEF DESCRIPTION OF THE DRAWINGS

A full and enabling disclosure of the present invention, including the best mode thereof, directed to one of ordinary skill in the art is set forth in the remainder of the specification, which makes reference to the appended figures, in which.

Figure 1:
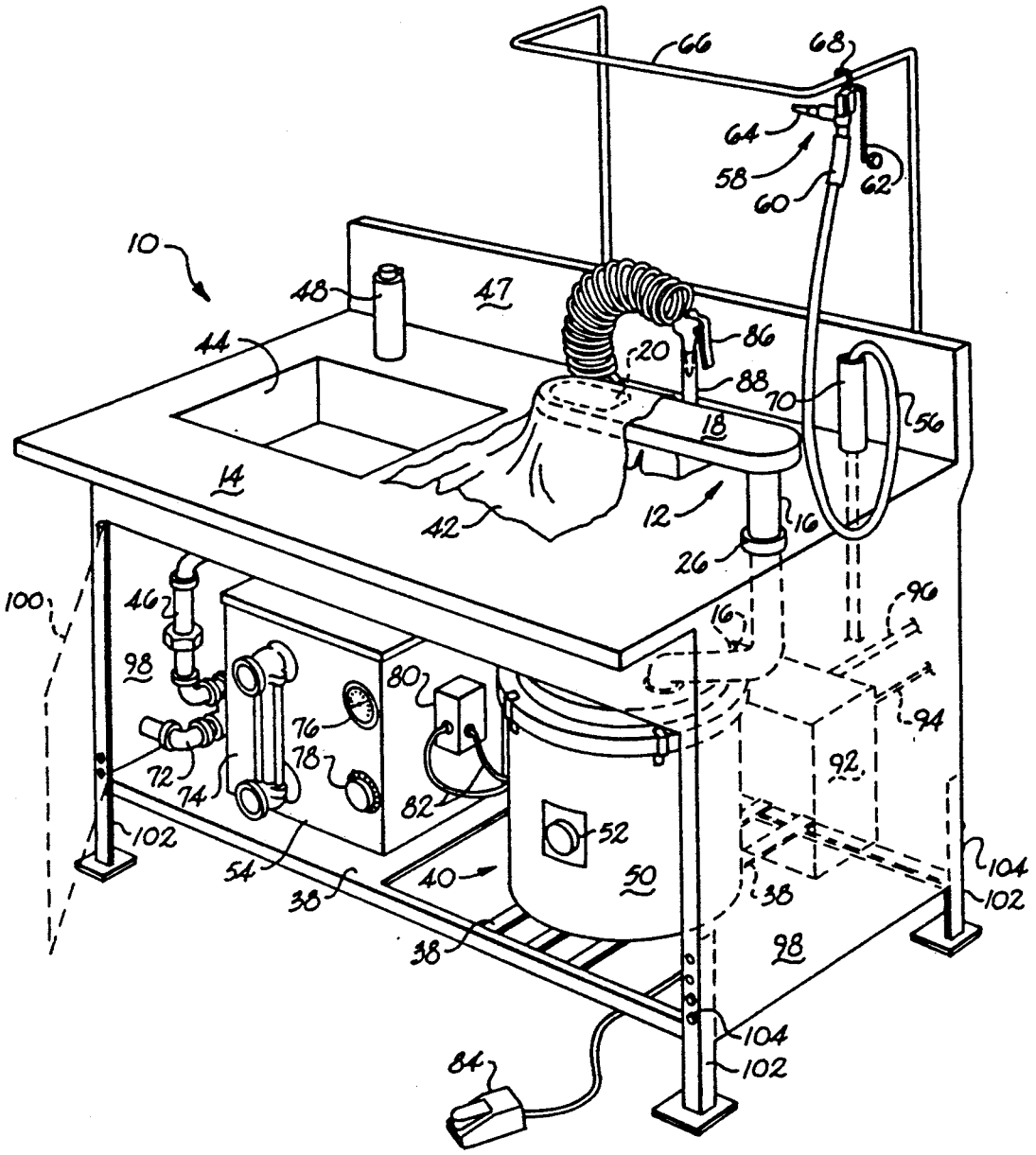
FIG. 1 is a perspective plan view of an exemplary embodiment of the present invention, for the purpose of illustrating both present apparatus and methodology.

Repeat use of reference characters throughout the present specification and appended drawings is intended to represent same or analogous features, elements, or steps of the invention.

DETAILED DESCRIPTION OF THE PREFERRED EMBODIMENTS

The present invention concerns both apparatus, i.e., system, and methodology which in various embodiments thereof achieves the objects and the advantages referenced above. Those of ordinary skill in the art will appreciate that the following discussion is by way of example only so as to provide such persons adequate information for making and using the subject invention (both apparatus and method aspects thereof). It should be appreciated that the invention is not strictly limited to the details of the exemplary embodiments discussed herewith, but instead the invention encompasses without limitation the broader aspects, features, and steps discussed herein.

Figure 2:
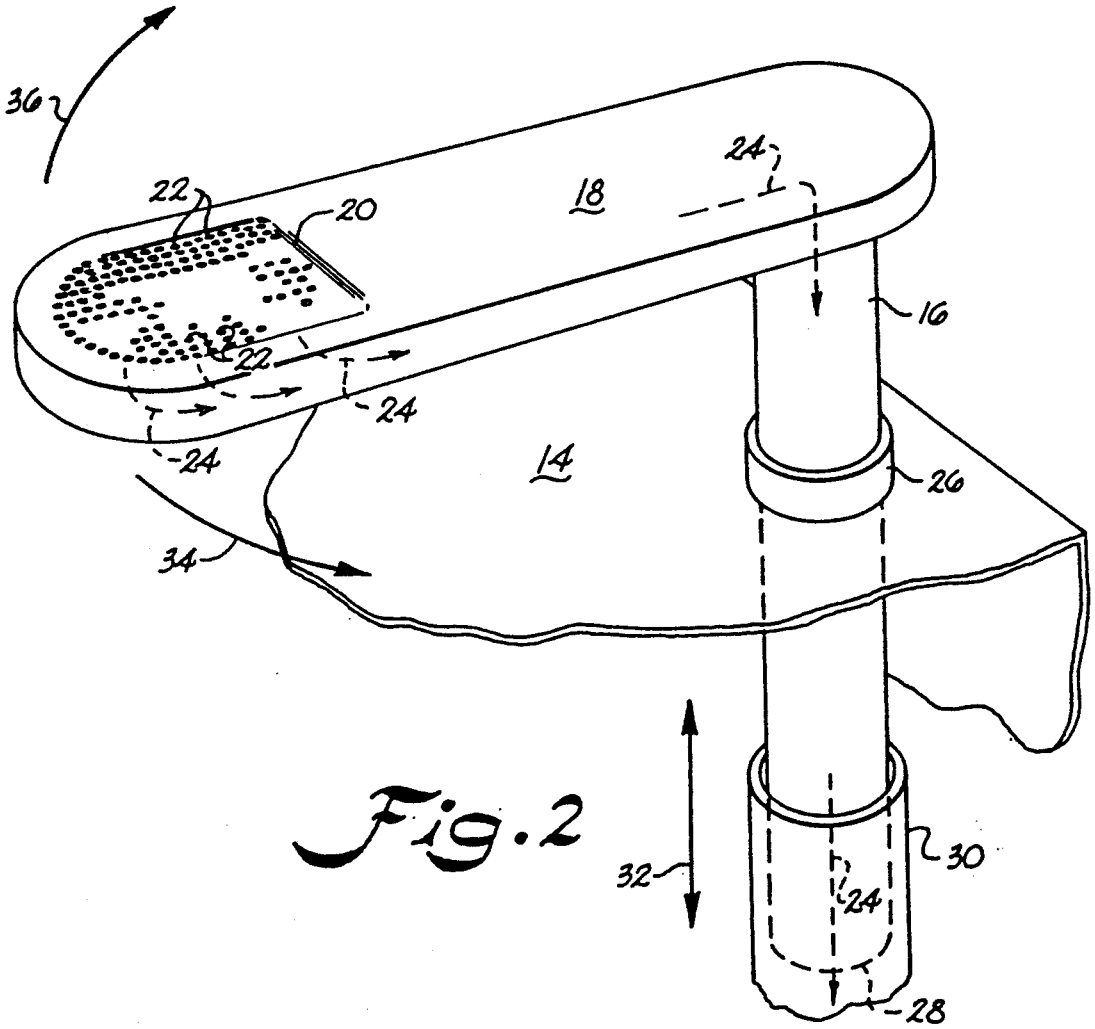
FIG. 2 is an enlarged, partial view of vacuum arm features in accordance with the present invention.

FIG. 1 comprises an illustration of a perspective plan view of an exemplary embodiment of the present invention, to which reference may be made for purposes of describing both the present apparatus and methodology. FIG. 2 is an enlarged partial view of vacuum arm features in accordance with the present invention, as more generally represented in present FIG. 1.

FIG. 1 represents an exemplary self-supporting workstation 10, which includes a generally upright vacuum arm 12 which extends above an upper work surface 14 thereof.

With reference to both FIGS. 1 and 2, vacuum arm 12 generally includes an upright extending member 16 which is generally hollow for vacuum communication with a substantially horizontal section 18 thereof. As further represented therein, vacuum arm 12 is preferably provided with a vacuum area 20, which may include a plurality of relatively small openings 22 (e.g., part of a grating or the like) so that vacuum force applied to the upright vacuum arm 12 is focused at vacuum area 20 thereof. As will be understood by those of ordinary skill in the art, a vacuum pathway is established just above vacuum area 20 and along the direction of dotted line arrows 24 through vacuum arm 12 towards a source of vacuum force. Such vacuum source is discussed in greater detail below.

As represented particularly in present FIG. 2, descending vacuum pipe or member 16 passes through a flange element 26 just at upper surface 14, and further continues through an opening (not shown) in surface 14. As represented in dotted line and by partial cutaway of surface 14, pipe 16 continues downward towards a source of vacuum with which it is operatively associated.

An alternative embodiment is also represented by present FIG. 2, wherein upright vacuum element 16 may terminate at an end thereof 28. As diagrammatically represented, such end 28 may terminate within another vacuum pipe element 30, with a substantial length or area of such two pipes 16 and 30 overlapping. The extent of the overlapping area would permit a relative sliding motion therebetween, as represented by double headed arrow 32. Such an arrangement would permit physical repositioning of the vacuum arm 12, and in particular would permit a workstation user or operator to vertically reposition the height of vacuum area 20 to facilitate use thereof. It should be apparent that an adjustable height contributes to efficient and safe operation of the overall present system and methodology.

Similarly, vacuum area 20 may be variously pivoted within a horizonal plane, as represented by the respective arrows 34 and 36. Again, such pivoting serves to facilitate adjustment of the overall device so as to meet the personal needs of each respective operator. It should be further apparent to those of ordinary skill in the art that other forms of adjustments may be provided, including variations to the above-referenced adjustments. For example, the horizontal plane pivoting of member 18 may be achieved through relative movement between elements 18 and 16 at their juncture, or by relative movement between elements 16 and 30 at their juncture.

As represented in dotted line in FIG. 1, vacuum pipe 16 or some other element may interconnect with a vacuum means supported on workstation 10, such as on a support rack 38 or the like. The exemplary vacuum means 40 preferably comprises an electrically powered self-contained vacuum which is operatively associated with vacuum arm 12 so as to apply relatively high vacuum force to a soiled garment 42 which is to be cleaned. Exemplary garment 42 may comprise a handkerchief or a garment or a piece of fabric or cloth with a desired portion thereof situated adjacent vacuum area 20. Normally, an area with a specific spot or stain is situated adjacent vacuum area 20, either with or without pretreatment of such stain. To facilitate pretreatment of any stain, upper work surface 14 includes, as illustrated, a relatively open area as well as preferably a sink 44 built thereinto. Such sink may drain through a trap 46 into a waste container supported on workstation 10, or may otherwise be interconnected to a locally available drainage system, i.e., the regular plumbing for the facility within which workstation 10 is used. A splashback panel 47 or similar may be provided to shield operations on surface 14.

By way of example, surface 14 is illustrated with a container 48 supported thereon. Such container is intended as broadly representing means for pretreating spots on the soiled garment to be cleaned by the application of water or petroleum based nonchlorinated cleaners thereto. In other words, container 48 may contain water or petroleum based nonchlorinated cleaners, which a workstation user or operator may use to pretreat spots on soiled garment 42 simply by directly applying the materials therein onto the spot. Container 48 may utilize a spray top, pump top, a removable cap, etc., and the specific details of such pretreating means do not form particular aspects of the subject invention. However, as will be appreciated by those of ordinary skill in the art, use of water or petroleum based nonchlorinated solvents or cleaners, particularly for pretreating spots, is a feature of various embodiments of the subject invention (both apparatus and method).

It is one preferred aspect of the subject invention that vacuum means 40 supply a relatively high vacuum force to vacuum arm 12 via vacuum component 16, etc. More specifically, it has been determined that one of the significant deficiencies of prior art spot cleaning systems and methods has been the lack of vacuum features such as form part of the present invention. Typically, for reasons discussed above, prior art spot cleaning systems have had relatively low vacuum force levels, such as in a range of about 20 to 30 inches of mercury of static pressure. Additionally, in many instances, there may be vacuum pressure losses for a variety of reasons, such as due to the external nature of the vacuum being utilized and the quality and nature of operative interconnections between the spot cleaning system and the external vacuum. In this instance, a self-contained source of vacuum such as vacuum means 40 is preferably utilized to provide a relatively high vacuum force of generally at least about 80 inches of mercury of static pressure, or even higher. In some instances, the vacuum force may be increased in accordance with the present invention to as much as 110 inches of mercury of static pressure, or even higher.

As another aspect of the subject invention pertaining to vacuum means 40, it is a present optional feature that such vacuum means 40 may be provided with a vacuum waste collector means 50 supported on workstation 10 for receiving materials vacuumed through vacuum arm 12 under the vacuum force applied thereto via vacuum component 16. Still further, it is a present feature that the vacuum force itself, within the constraints of the subject invention, may be varied to satisfy specific usage purposes. For example, different fabrics or garments may preferably be operated with different vacuum forces so as to most efficiently clean spots therefrom without damage to the fabric or garment. FIG. 1 includes representation of a variable vacuum control 52 which may be utilized in accordance with the present invention, as understood by one or ordinary skill in the art, for satisfying such aspects of the present invention.

While a variety of commercially available vacuum means may be utilized in accordance with the practice of the present invention (both method and apparatus thereof), one presently preferred exemplary embodiment thereof comprises a wet/dry pick-up vacuum for industrial applications, as sold by the Dayton Company under Model Nos. 22974 and 62093. Such devices may comprise two-stage, 3.5 horsepower industrial vacuums with preferably stainless steel tanks for the storage of waste attracted by the vacuum force generated therewith. It will be understood that the exterior of tank 50 may comprise such a stainless steel tank, and that additional details of such electrically powered self-contained vacuum need not be discussed for a full and enabling disclosure and understanding of the present invention. Accordingly, a schematic representation of such an exemplary vacuum means 40 is sufficient in present FIG. 1.

The subject invention, both method and apparatus, also preferably encompasses use of electric water boiler means (i.e., steam generation means) generally represented by referenced character 54. Such may be supported on the workstation support rack 38, as illustrated, or may be otherwise associated therewith in a relatively nearby location, such as adjacent workstation 10. Any commercially available boiler means, such as electrically powered units, may be utilized for providing an output of steam which is operatively associated (i.e.. interconnected) with steam hose 56. One example of such are electric water boilers for steam generation, commercially available from Reimers Company of Clearbrook, Va.

Steam hose 56 passes through an opening (not shown) in upper surface 14 of workstation 10, and interconnects water boiler means 54 with a controllable steam spray gun 58. Such steam spray gun may be of a type as is well known in the industry, such as having a wooden handle or the like 60 and a pivotable trigger device 62 with which a workstation user or operator causes steam available in steam hose 56 to be discharged through nozzle 64. As is well understood by those of ordinary skill in the art, such steam spray gun may be provided with an adjustment stem or the like, by which the character of the spray emerging from nozzle 64 may be controlled. Similarly, the degree to which lever 62 is depressed likewise controls the flow rate and to some extent, the spray pattern, from nozzle 64.

As is illustrated, the present workstation 10 preferably further includes a hanging rod 66 or similar supported thereon, which supports spray gun 58 with a hanging hook 68 when the spray gun is not being used. Thus rod 66 comprises one example of a means for resting gun 58. Alternative configurations of such arrangement may be practiced within the spirit and scope of the present invention, i.e.. so long as gun 58 is safely secured. Likewise, various protective arrangements, such as collar 70 may be provided for the protection of steam hose 56.

With more specific reference to boiler means 54, such comprises a self-contained steam generation means which is electrically operated, as understood by those of ordinary skill in the art. Boiler means 54 may receive a supply of water through pipe 72, or may be replenished with water by means for holding additional water, such as a tank or similar supported on workstation 10 rearward of boiler means 54. Boiler means 54 itself, of course, contains a vessel for water, with which steam is generated. As understood by those of ordinary skill in the art, operation of boiler means 54 may be monitored through use of the water gauge 74 and the pressure gauge 76 thereon. Dial 78 represents a heat setting, i.e., a control dial for the electrical heating elements of boiler means 54, which receive electrical power through a junction box such as box 80 and incoming power conductors 82. Such power conductors may also interconnect with the other electrically powered features of the subject invention such as vacuum means 40. In connection therewith, an on/off electrical device such as foot pedal 84 may be interconnected with power lines 82 relative vacuum means 40 so that an operator may use his or her feet for switching vacuum means 40, thereby leaving both hands free for manipulation of the soiled garment 42 to be cleaned.

While workstation 10 is adapted for externally receiving electrical power, such as from the normal power service to a facility at which it is used, it will be understood by those of ordinary skill in the art that an electrical generator may also be used so as to render the entire arrangement fully self-contained, as opposed to being substantially self-contained (e.g., using external electrical power and/or an external water source).

For some present embodiments, other features may be externally powered in various ways within the spirit and scope of the subject invention. For example, the drying force provided by the vacuum force exerted at vacuum area 20 may be augmented selectively by the direction of compressed air onto garment 42. To such end, a compressed air gun 86 of conventional construction and operation is shown resting on a stand-up rest 88 supported on workstation 10. A compressed air hose 90 operatively interconnects such air gun 86 with a source of compressed air. One example of such source is represented in dotted line as an electrically powered air compressor 92, supported on support rack 38 of workstation 10. Incoming electrical power line 94 and compressed air output hose 96 thereof are also represented in dotted line. The reason for such dotted line representation is that an "external" source of compressed air may be utilized in accordance with the present invention. In other words, a source of compressed air available at the commercial plant with which workstation 10 is utilized may be operatively associated with compressed air hose 90.

Those of ordinary skill in the art will appreciate that various other features may be practiced in various embodiments of the subject invention, many of which features are subject to the selection of the particular practitioner of the invention. For example, workstation 10 may include side panels 98, a rear panel, and closeable front doors (such as door 100 diagrammatically represented in dotted line), by which the entire self-contained features thereof may be enclosed for safety and aesthetic reasons. Such a door 100 may be of transparent plastic construction if visibility of the internal workings is desired, such as to permit monitoring of water gauge 74 or pressure gauge 76.

Other alternative features may be practiced. For example, the upper surface 14 and built-in sink 44 may comprise stainless steel, as may the members of vacuum arm 12, so as to prevent rust or other stains thereto which would be disadvantageous with respect to cleaning garments 42. Also, the legs 102 of workstation 10 may be variously adjustable, such as with movable bolt positions 104, as diagrammatically represented, so that upper surface 14 may generally be leveled (as well as the equipment means 40 and 54) regardless of any unevenness of the commercial plant floor where workstation 10 is utilized.

With more specific reference to examples of present methods for commercially cleaning spots from garments utilized in the present invention, the following description is provided.

First is preferably provided a self-supporting workstation 10 supporting thereon a generally upright vacuum arm 12 or its equivalent with a vacuum area (such as 20) at which vacuum force applied to arm 12 is focused, an electric water boiler means or steam generator means 54 for generating steam at a steam output thereof, a controllable steam spray gun 58 and steam hose 56 operatively interconnected with the boiler means output steam output, and vacuum means 40 for supplying a relatively high vacuum force to the vacuum arm 12. As mentioned, various external sources might be utilized in some embodiments. After obtaining such an apparatus or system, a soiled garment 42 to be cleaned is placed onto the vacuum arm 12 with a spot or stain on such garment situated at the vacuum area 12. Thereafter, the vacuum means 40 is operated (possibly such as with foot pedal switch 84) and the workstation user manipulates the steam spray gun 58 so as to apply steam to garment 42. During such time, a relatively high vacuum force in accordance with the invention is also applied to the garment 42 through vacuum area 20 so that the garment is both steam cleaned and dried.

As is understood from the foregoing, garment 42 in accordance with certain embodiments of the present invention may be pretreated with a water or petroleum based non-chlorinated cleaner so that the applying of steam thereto acts as a flushing agent for such cleaner while the relatively high vacuum force acts as a drying agent for such cleaner. In still further present embodiments, a stream of compressed air may be applied to garment 42 so as supplement drying thereof by the vacuum force.

Those of ordinary skill in the art will further appreciate from the foregoing that substantially low levels of water are utilized in practice of the present invention. Yet, it may be reported from tests that generally good to excellent cleaning results have been obtained for a variety of fabrics, with the less limited positive results coming in highly problematic situations such as magic marker stains (i.e., indelible ink) on pure nylons or pure silk fabrics. Testing of the subject invention has even surprisingly shown improved cleaning over prior art approaches including those using chlorinated solvents. Solvents such as petroleum-based solvents may also be practiced, as noted above preferably only so long as chlorinated solvents are not used.

To summarize additional aspects of the present invention, the following is offered. It may be considered that the subject invention makes significant use of water itself as a cleaner, in place of chlorinated solvents. Yet, due to the advantageous relatively low consumption of water, either a self-contained water vessel may be utilized, or a water drain line may be hooked directly to the apparatus. Again, due to the relatively low consumption rate of water, a relatively self-contained electric powered boiler means may be utilized for the purpose of converting water to steam, and depending on the size of the boiler, such may be installed directly within workstation 10 or just outside of such workstation.

It will be appreciated that steam may be considered in some embodiments as constituting the main cleaner, while steam may be regarded as the flushing agent when other cleaners, such as water-based chemicals or petroleum based nonchlorinated chemicals, are used to pretreat stains more difficult to remove.

One concise statement of utilizing an exemplary workstation such as 10 of present FIG. 1 follows. Once desirably situated and preferably leveled, electrical power may be applied thereto, and the boiler means 54 may be operated so as to generate steam. Once steam is available, a soiled garment (either pretreated or not, in accordance with the different embodiments of the invention) may be placed over vacuum area 20, as shown in FIG. 1. Foot pedal switch 84 may be depressed to activate the relatively high vacuum force in accordance with the present invention. Utilizing the steam hand gun 58, the operator may direct steam towards vacuum area 20 or thereabouts, working the soiled garment 42 until it is cleaned. Pretreatment cleaners (water or petroleum based nonchlorinated solvents) may be utilized on relatively more difficult stains to remove. In such instance, both the stain (particulate matter and the like) and the cleaner are flushed from garment 42 with the steam (and partly by the vacuum). In some present embodiments, a relatively high vacuum force (e.g., at least about 80 inches of mercury of static pressure may be applied to a soiled garment which has only been pretreated with a nonchlorinated cleaner (e.g., water based or petroleum based). Then, the vacuum force acts to flush both the soil and the pretreatment cleaner from such garment. At the same time, there is a drying effect on the garment due to the vacuum force.

Subsequently, the area may be dried through continued operation of the vacuum force, or drying may be augmented by the direction of compressed air from hand gun 86. In some instances, the vacuum force alone will be sufficient to dry the garment 42.

As understood by those of ordinary skill in the art, tank 50 associated with vacuum means 40 collects the dirty steam water in the event that environmental concerns contraindicate direct discharge thereof into the regular water treatment drains. Again, advantageously due to the relatively low rate of water consumption with the overall methodology and apparatus, collection container 50 can be utilized for a relatively lengthy period of time without requiring emptying thereof. To a certain extent, the water consumption rate can also be controlled by the operator, who has the option to relatively lightly depress handle 62 of gun 58 so as to control the amount of steam emerging therefrom.

It should be further understood by those of ordinary skill in the art that the foregoing presently preferred embodiments (both apparatus and method) are exemplary only, and that the attendant description thereof is likewise by way of words of example rather than words of limitation and their use does not preclude inclusion of such modifications, variations, and/or additions to the present invention as would be readily apparent to one or ordinary skill in the art, the scope of the present invention being set forth in the appended claims.

What is claimed is:

1. A method of commercially spot cleaning soiled garments without the use of chlorinated solvents, said method comprising:

pretreating spots on the soiled garment to be cleaned by the application of nonchlorinated cleaners thereto; and applying a relatively high vacuum force to the pretreated spots so as to flush both soil and pretreatment cleaner therefrom and for drying the garment being cleaned;

further including providing a substantially self-contained workstation having an upper work surface on which a user may work a soiled garment to be cleaned for pretreating same, a self-contained vacuum means for generating said relatively high vacuum force, a stand-up vacuum arm connected to said vacuum means and adapted for receiving a soiled garment thereon, and vacuum waste collector means carried on said workstation and associated with said vacuum means for collecting waste materials vacuumed through said vacuum arm under said vacuum force; and further including providing said substantially self-contained workstation with a self-contained steam generator means and associated steam spray gun and interconnecting hose for selectively applying steam to the soiled garment.

2. A method as in claim 1, wherein said relatively high vacuum force is at least about 80 inches of mercury of static pressure.

3. A method as in claim 2, wherein said nonchlorinated cleaner is petroleum based.

4. A method as in claim 3, further including:

providing an air compressor and air gun carried on said workstation for selectively applying compressed air to the garment for enhanced drying thereof;

providing means for holding additional water, associated with said workstation, for replenishing water to said steam generator means; and providing said workstation with adjustable legs for leveling said upper work surface thereof, a sink built into said upper work surface, and a splashback panel adjacent said upper work surface.

5. A method as in claim 1, wherein said nonchlorinated cleaner is petroleum based.

6. A method as in claim 5, further including providing an air compressor and air gun carried on said workstation for selectively applying compressed air to the garment for enhanced drying thereof.

7. A method as in claim 6, further including:

providing means for holding additional water, associated with said workstation, for replenishing water to said steam generator means; and providing said workstation with adjustable legs for leveling said upper work surface thereof, a sink built into said upper work surface, and a splashback panel adjacent said upper work surface.

8. A method as in claim 7, wherein said relatively high vacuum force is at least about 80 inches of mercury of static pressure.

9. A method as in claim 1, further including providing an air compressor and air gun carried on said workstation for selectively applying compressed air to the garment for enhanced drying thereof.

10. A method as in claim 1, further including providing means for holding additional water, associated with said workstation, for replenishing water to said steam generator means.

11. A method as in claim 1, further including providing said workstation with adjustable legs for leveling said upper work surface thereof, a sink built into said upper work surface, and a splashback panel adjacent said upper work surface.

12. A system for commercially spot cleaning soiled garments without the use of chlorinated solvents, said system comprising:

a user workstation;

means for pretreating spots on the soiled garment to be cleaned by the application of nonchlorinated cleaners thereto; and vacuum means for selectively applying a relatively high vacuum force to the pretreated spots, so as to flush both soil and pretreatment cleaner therefrom as such garment is drying with said vacuum force;

wherein said workstation includes a substantially self-contained workstation having an upper work surface on which a user may work a soiled garment to be cleaned for pretreating same, a self-contained vacuum means for generating said relatively high vacuum force, a stand-up vacuum arm connected to said vacuum means and adapted for receiving a soiled garment thereon, and vacuum waste collector means carried on said workstation and associated with said vacuum means for collecting waste materials vacuumed through said vacuum arm under said vacuum force; and means for spraying steam including a self-contained steam generator means and associated steam spray gun and interconnecting hose for spraying said steam on the soiled garment.

13. A system as in claim 12, wherein said relatively high vacuum force is at least about 80 inches of mercury of static pressure.

14. A system as in claim 13, wherein said nonchlorinated cleaner is petroleum based.

15. A system as in claim 14, further including:

an air compressor and air gun carried on said workstation for selectively applying compressed air to the garment for enhanced drying thereof; and means for holding additional water, associated with said workstation, for replenishing water to said steam generator means;

wherein said workstation further includes adjustable legs for leveling of said upper work surface thereof, a sink built into said upper work surface, and a splashback panel adjacent said upper work surface; and said system further including means for adjusting the position of said vacuum arm to facilitate access thereto by a system user.

16. A system as in claim 12, wherein said nonchlorinated cleaner is petroleum based.

17. A system as in claim 16, further including an air compressor and air gun carried on said workstation for selectively applying compressed air to the garment for enhanced drying thereof.

18. A system as in claim 17, further including:

means for holding additional water, associated with said workstation, for replenishing water to said steam generator means; and wherein said workstation further includes adjustable legs for leveling of said upper work surface thereof, a sink built into said upper work surface, and a splashback panel adjacent said upper work surface.

19. A system as in claim 18, further including:

means for adjusting the position of said vacuum arm to facilitate access thereto by a system user; and wherein said relatively high vacuum force is at least about 80 inches of mercury of static pressure.

20. A system as in claim 12, further including an air compressor and air gun carried on said workstation for selectively applying compressed air to the garment for enhanced drying thereof.

21. A system as in claim 12, further including means for holding additional water, associated with said workstation, for replenishing water to said steam generator means.

22. A system as in claim 12, wherein said workstation further includes adjustable legs for leveling of said upper work surface thereof, a sink built into said upper work surface, and a splashback panel adjacent said upper work surface.

23. A system as in claim 12, further including means for adjusting the position of said vacuum arm to facilitate access thereto by a system user.

* * * * *